United States Patent [19]

Naylor et al.

[11] Patent Number: 4,679,284

[45] Date of Patent: Jul. 14, 1987

[54] YARN ENTANGLING AIR JET

[75] Inventors: Geoffrey Naylor; Christopher J. Lawrence, both of Macclesfield, United Kingdom

[73] Assignee: Rieter-Scragg Limited, Cheshire, United Kingdom

[21] Appl. No.: 865,340

[22] Filed: May 21, 1986

[30] Foreign Application Priority Data

Jul. 20, 1985 [GB] United Kingdom ..... 8518390

[51] Int. Cl.[4] ..... D02G 1/16; D02J 1/08

[52] U.S. Cl. ..... 28/272

[58] Field of Search ..... 28/271, 272, 274, 275, 28/276

[56] References Cited

U.S. PATENT DOCUMENTS

| | | | |
|---|---|---|---|
| 3,389,444 | 6/1968 | Fletcher et al. | 28/274 |
| 4,011,640 | 3/1977 | Keith | 28/274 |
| 4,217,323 | 8/1980 | Foster et al. | 28/271 X |
| 4,251,904 | 2/1981 | Sano et al. | 28/271 X |
| 4,475,693 | 10/1984 | Munro et al. | 28/274 X |

FOREIGN PATENT DOCUMENTS

| | | | |
|---|---|---|---|
| 0121010 | 10/1984 | European Pat. Off. | 28/272 |
| 0140526 | 5/1985 | European Pat. Off. | 28/272 |
| 5932573 | 8/1984 | Japan | 28/271 |
| 6040534 | 9/1985 | Japan | 28/271 |
| 1316440 | 5/1973 | United Kingdom . | |
| 1422615 | 1/1976 | United Kingdom . | |
| 2118581 | 11/1983 | United Kingdom . | |

*Primary Examiner*—Robert R. Mackey

*Attorney, Agent, or Firm*—Oblon, Fisher, Spivak, McClelland & Maier

[57] ABSTRACT

A yarn entangling jet has a yarn passageway extending therethrough and an air inlet passageway communicating with an outlet portion of the yarn passageway adjacent the junction with an inlet portion thereof. The outlet portion is preferably of triangular cross-section, comprising a base wall opposite the air inlet passageway and two converging side walls. The inlet portion has one wall coplanar with the base wall and an inlet surface which converges towards the base wall in the direction towards the junction with the outlet portion. An inlet yarn guide is positioned to ensure that the yarn approaches the base wall at the desired angle less than 180°. The jet is in two parts secured together with a threading slot therebetween at one side of the yarn passageway spaced from the base wall towards the apex of the outlet portion.

20 Claims, 5 Drawing Figures

YARN ENTANGLING AIR JET

BACKGROUND OF THE INVENTION

This invention relates to apparatus for processing textile yarns, and in particular to yarn entangling air-jets, which are used to compact or produce intermittent hard entanglements (nips) spaced along the length of continuous filament yarns, particularly during the extrusion and draw-texturing stages to improve subsequent processing performance.

DESCRIPTION OF THE PRIOR ART

Many designs and arrangements of yarn entangling air jets are known, from which it has become established that small changes in configuration and dimensions of the passageways through the jet for the yarn and for the air can create large changes in the characteristics of a yarn processed by means of an air jet. Despite the numerous designs and arrangements of air jets for entangling yarns, each tends to have some drawback as regards the quality, eg. nip frequency, regularity and intensity, of the entangled yarn produced thereby, consistency of that quality from time to time from any one jet and from jet to corresponding jet, quantity of air consumed, or other factors.

OBJECT OF THE INVENTION

It is an object of the present invention to provide an air jet for entangling yarn in which good quality entangled yarn is consistently produced, providing uniformity of entangled yarn from jet to jet, and which is economical in air consumption.

SUMMARY OF THE INVENTION

The invention provides apparatus for processing yarn comprising an entangling jet having a yarn passageway extending therethrough, and an air inlet passageway communicating with said yarn passageway, said yarn passageway having a base surface and an inlet portion and an outlet portion, said yarn passageway being defined in said outlet portion by said base surface and by a side surface or surfaces providing a reducing width of passageway away from said base surface, and said yarn passageway being defined in said inlet portion by said base surface and by an inlet surface opposed to and converging towards said base surface in a direction towards said outlet portion.

Said base surface may be substantially planar, and said inlet surface may converge at substantially 30° to said base surface.

Said air inlet passageway may communicate with said outlet portion of said yarn passageway. Said air inlet passageway may communicate with said outlet portion of said yarn passageway adjacent the junction between said inlet and said outlet portions. Preferably said air inlet passageway communicates with said yarn passageway at a location opposed to said base surface. The axis of said air inlet passageway may be inclined at an angle of at least 90°, preferably between 90° and 100°, for example between 92° and 93°, to the axis of said outlet portion in the direction of yarn travel therealong, whereby the inlet yarn path is inclined at an angle of less than 90° to said axis of said air inlet passageway, and improved forwarding of the yarn through the jet is obtained due to the yarn being constrained below the main air flow at the input of the jet.

The outlet portion of said yarn passageway may be of triangular cross section, and may be of isosceles triangular cross-section, comprising said base surface and two side walls which may be mutually inclined at between 40° and 60°, preferably at substantially 50°.

The jet may be formed in two parts separably secured to each other. The parts may have, on one side of said yarn passageway, two mutually contacting surfaces, which are preferably coplanar with said base surface, and, on the opposed side of said yarn passageway, mutually spaced surfaces defining between them a yarn threading slot. Said threading slot may extend into said yarn passageway along an opening which is substantially parallel with said base surface and spaced therefrom towards an apex of said outlet portion formed by said side surface or surfaces thereof.

BRIEF DESCRIPTION OF THE DRAWINGS

The invention will now be further described with reference to the accompanying drawing in which.

DETAILED DESCRIPTION OF THE PREFERRED EMBODIMENTS

Figure 1:
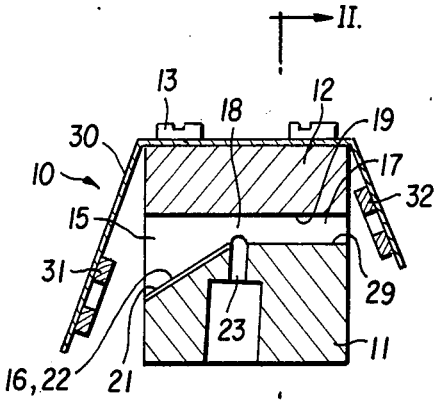
FIG. 1 is side section of an entangling jet in longitudinal section.

Referring now to the figures, there is shown an entangling jet 10 comprising two parts 11, 12 which are separably secured to each other by two screws 13 received in threaded bores 14 in the lower part 11. The two parts 11, 12 may be of any suitable material and may be of differing coated or plated materials. For example, both parts 11, 12 may be of steel, or the upper or anvil part 12 may be of a ceramic material.

Figure 2:
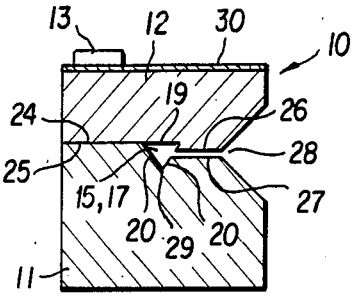
FIG. 2 is a section on line II—II of FIG. 1.
Figure 2A:
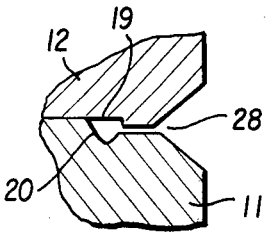
FIG. 2*a* is a view similar to FIG. 2 of an alternative embodiment.

The two parts 11, 12 are secured to each other so as to provide a yarn passageway 15 through the jet 10, the passageway 15 having an inlet portion 16 and an outlet portion 17 which meet at a junction 18. The outlet portion 17 is of isosceles triangular cross-section comprising a base wall 19 and two side walls 20 which are mutually inclined at an angle of 50° and which meet an an apex 29. Other cross-sections of the outlet portion 17 may be used if desired. For example, the angle between the sidewalls 20 may be in the range 40° to 60°. Alternatively, a semi-circular or U-shaped cross-section (illustrated in FIG. 2*a*) may be provided, but in each case the section is defined by a base wall 19 and side walls 20 providing a reducing width of the passageway 15 in the outlet portion 17 thereof in a direction away from the base wall 19.

The inlet portion 16 of the yarn passageway 15 is defined by a coplanar continuation of the base wall 19 of the outlet portion 17, and by an inlet surface 21 which converges towards base wall 19 in a direction towards the outlet portion 17 at an angle of 30°. The inlet surface 21 is of V-shaped configuration with sides mutually inclined at 50°, or such other angle as is formed between the side walls 20 of the outlet portion 17, and is formed by cutting a slot 22 in the lower part 11 of reducing depth towards the junction 18 of the inlet and outlet portions 16, 17. The inclination of the inlet surface 21 to the base wall 19 enables there to be a yarn path in the inlet portion 16 which is inclined to the axis of the yarn passageway 15 in the outlet portion 17 at an angle of less than 180°—i.e., of 150° in the embodiment shown, although this angle may be varied between 170° and 110° if desired.

A guide assembly 30 (see FIG. 1) is secured to the anvil part 12 by one of the screws 13, thereby enabling the guide assembly 30 to be removed without disturbing the mutual setting of the parts 11, 12 of the jet 10. The guide assembly 30 comprises an inlet guide 31 and an outlet guide 32, the latter being aligned with the axis of the outlet portion 17 and the former being positioned so as to ensure that the yarn enters the inlet portion 16 at the desired angle to the base wall 19.

Also formed in the lower part 11 of the jet 10 is an air inlet passageway 23 which enters the outlet portion 17 of the yarn passageway 15 adjacent the junction 18. The axis of the air inlet passageway 23 is inclined to the axis of the outlet portion 17 of the yarn passageway 15 in the direction of yarn travel therealong at an angle of between 92° and 93°, although this angle may be varied in the range 90° to 100° if desired. This inclination ensures that the air provides a yarn forwarding force which counteracts any friction drag on the yarn due to its contact with the inlet surface 21 and/or the base wall 19 of the outlet portion 17.

The jet 10 is formed of the two parts 11, 12 for simplicity of manufacture and restriction of air turbulence, as well as to allow for the two parts to be made of differing materials if desired. Due to this construction, the yarn passageway 15 is easily formed.

Figure 3:
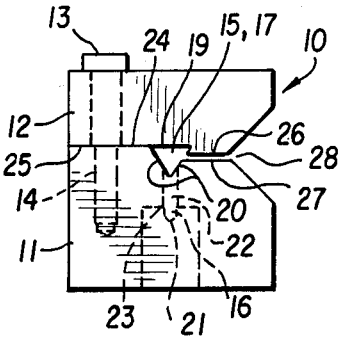
FIG. 3 is an end elevation with the guide assembly removed.
Figure 4:
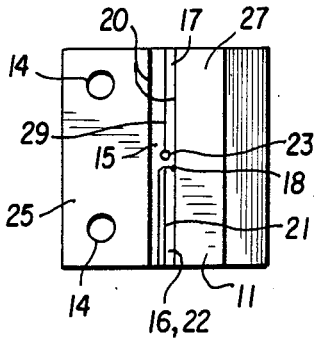
FIG. 4 is a plan view with the top removed.

The two parts 11, 12 are secured together so that, on one side of the yarn passageway 15, there are two mutually engaging surfaces 24, 25 which are coplanar with the base wall 19. On the other side of the yarn passageway 15, the two parts 11, 12 have mutually spaced surfaces 26, 27 which define between them a yarn threading slot 28. The yarn threading slot 28 is parallel with, but spaced from, the base wall 19 towards the apex 29 of the outlet portion 17 of the yarn passageway 15 formed by the side walls 20. Preferably the yarn threading slot 28 enters the outlet portion 17 of the yarn passageway 15 substantially mid-way between the base wall 19 and the apex 29. With such a configuration, two significant disadvantages of alternative configurations are avoided. If the surface 26 were coplanar with the base wall 19 and the surface 24, the air issuing from the air inlet passageway 23 would tend to carry the yarn into the threading slot 28 and out of the jet 10, thereby failing to process the yarn properly or even causing damage thereto. If both the surface 24 and the surface 26 were spaced from base wall 19, the cutting of a dovetail section would be required to form the base of the yarn passageway 15, and such a cut-out could not be cut, ground, and polished to provide the desired surface characteristics as easily as can the configuration shown in FIGS. 2 and 3.

By means of the invention, a yarn entangling jet is provided which can be easily manufactured and cleaned or otherwise serviced, which can be readily threaded, and which produces very good quality entangled yarn consistently over a period of use, uniformly from jet to jet, and at an economical consumption of air.

We claim:

1. An entangling jet having a yarn passageway extending therethrough with an air inlet passageway and a yarn threading slot each communicating with said yarn passageway, said yarn passageway having a base surface, an inlet portion and an outlet portion and being defined in said outlet portion by said base surface and by side surfaces defining an apex opposed to said base surface and providing a reducing width of passageway away from said base surface towards said apex, said yarn passageway being defined in said inlet portion by said base surface and by an inlet surface opposed to and converging towards said base surface in a direction towards outlet portion, said air inlet passageway communicating with said apex of said outlet portion, one side surface of said yarn passageway having an opening therein which is substantially parallel with said base surface and spaced therefrom towards said apex and with which said yarn threading slot communicates, said jet being formed by two parts separably secured to each other, said two parts having at said one side of said yarn passageway two mutually spaced surfaces defining between them said opening and said yarn threading slot, and at the other side of said yarn passageway two mutually contacting surfaces.

2. An entangling jet according to claim 1 wherein said base surface is planar.

3. An entangling jet according to claim 2 wherein said inlet surface converges towards said base surface at between 10° and 70°.

4. An entangling jet according to claim 3 wherein said inlet surface converges towards said base surface at substantially 30°.

5. An entangling jet according to claim 2 comprising a junction between said inlet portion and said outlet portion and said air inlet passageway communicates with said outlet portion adjacent said junction.

6. An entangling jet according to claim 2 wherein said outlet portion has an axis, and said air inlet passageway has an axis which is inclined at an angle of at least 90° to said axis of said outlet portion in the direction of yarn travel therealong.

7. An entangling jet according to claim 6 wherein the axis of said air inlet passageway is inclined at between 90° and 100° to the axis of said outlet portion in the direction of yarn travel therealong.

8. An entangling jet according to claim 2 wherein said outlet portion is of triangular cross-section.

9. An entangling jet according to claim 8 wherein said outlet portion is of isosceles triangular cross-section, comprising said base surface and two side walls mutually inclined at between 40° and 60°.

10. An entangling jet according to claim 9 wherein said side walls are mutually inclined at substantially 50°.

11. An entangling jet according to claim 2 wherein said two mutually contacting surfaces are coplanar with said base surface.

12. An entangling jet according to claim 1 comprising a guide assembly having an inlet guide and an outlet guide.

13. An entangling jet according to claim 12 wherein said outlet portion has an axis and said outlet guide is aligned with said axis of said outlet portion.

14. An entangling jet according to claim 12 wherein said two parts are secured to each other by at least two screws, and said guide assembly is secured to one of said parts by one of said screws.

15. An entangling jet comprising:

(a) a lower part having an upper surface, a lower surface, a front surface, a rear surface, and two side surfaces, said upper surface of said lower part comprising, beginning at a first one of said two side surfaces of said lower part, a first planar surface extending from said front surface of said lower part to said rear surface of said lower part, a wall extending from said front surface of said lower part to said rear surface of said lower part and forming the bottom of a yarn passageway, a second planar surface parallel to but spaced downwardly from said first planar surface of said lower part, and a downwardly extending guide surface extending from said second planar surface of said lower part to the second one of said two side surfaces of said lower part and from said front surface of said lower part to said rear surface of said lower part, said yarn passageway comprising an inlet portion and an outlet portion, the height of said inlet portion being at a maximum at said front surface of said lower portion and sloping to a minimum where said inlet portion meets said outlet portion, an air inlet passageway being formed in said lower part and extending from said lower surface of said lower part to said yarn passageway where said inlet portion meets said outlet portion;

(b) an upper part having an upper surface, a lower surface, a front surface, a rear surface, and two side surfaces, said lower surface of said upper part comprising, beginning at a first one of said two side surfaces of said upper part, a first planar surface extending from said front surface of said upper part to said rear surface of said upper part, said first planar surface of said upper part being sized, shaped, and positioned to make surface abutting contact with said first planar surface of said lower part, a base wall extending from said front surface of said upper part to said rear surface of said upper part and forming the top of said yarn passageway, said base wall being coplanar with said first planar surface of said upper part, a second planar surface parallel to but spaced downwardly from said first planar surface of said upper part, said second planar surface of said upper part being sized, shaped, and positioned to be parallel to but spaced from said second planar surface of said lower part to define a yarn threading slot therebetween, and an upwardly extending guide surface extending from said second planar surface of said upper part to the second one of said two side surfaces of said upper part and from said front surface of said upper part to said rear surface of said upper part; and (c) means for releasably connecting said upper and lower parts together.

16. An entangling jet as recited in claim 15 wherein the lower surface of said inlet portion converges toward said base wall at an angle of between 10° and 70°.

17. An entangling jet as recited in claim 16 wherein the lower surface of said inlet portion converges toward said base wall at an angle of at least substantially 30°.

18. An entangline jet as recited in claim 15 wherein said wall forming the bottom of said yarn passageway is formed of two side walls meeting an a linear apex and diverging from each other at an angle of between 40° and 60°.

19. An entangling jet as recited in claim 18 wherein said two side walls diverge from each other at an angle of at least substantially 50°.

20. An entangling jet as recited in claim 15 wherein said wall forming the bottom of said yarn passageway is at least substantially semi-circular in cross-section.

* * * * *